US007711471B2

(12) United States Patent
Takahashi et al.

(10) Patent No.: US 7,711,471 B2
(45) Date of Patent: May 4, 2010

(54) FUEL INJECTION CONTROL METHOD

(75) Inventors: Takeshi Takahashi, Osaka (JP); Takao Kawabe, Osaka (JP)

(73) Assignee: Yanmar Co., Ltd., Osaka (JP)

( * ) Notice: Subject to any disclaimer, the term of this patent is extended or adjusted under 35 U.S.C. 154(b) by 225 days.

(21) Appl. No.: 11/912,656

(22) PCT Filed: May 9, 2006

(86) PCT No.: PCT/JP2006/309332

§ 371 (c)(1),
(2), (4) Date: Nov. 1, 2007

(87) PCT Pub. No.: WO2006/134738

PCT Pub. Date: Dec. 21, 2006

(65) Prior Publication Data

US 2009/0012696 A1 Jan. 8, 2009

(30) Foreign Application Priority Data

Jun. 15, 2005 (JP) ..... 2005-175240

(51) Int. Cl.
*F02D 41/30* (2006.01)

(52) U.S. Cl. ..... 701/103; 701/114; 123/179.4

(58) Field of Classification Search ..... 701/103–105, 701/110–115; 123/DIG. 8, 179.4, 436, 478
See application file for complete search history.

(56) References Cited

U.S. PATENT DOCUMENTS 4,439,989 A 4/1984 Yamakawa
5,988,144 A * 11/1999 Yoshioka et al. ..... 123/493
6,079,511 A * 6/2000 Iwata ..... 180/197
6,199,005 B1 * 3/2001 Iwata ..... 701/87
6,257,207 B1 * 7/2001 Inui et al. ..... 123/491
6,401,684 B2 * 6/2002 Hori et al. ..... 123/198 F
6,493,627 B1 * 12/2002 Gallagher et al. ..... 701/104
6,810,860 B2 * 11/2004 Tani et al. ..... 123/491

(Continued)

FOREIGN PATENT DOCUMENTS

FR 2 827 911 A 1/2003

(Continued)

OTHER PUBLICATIONS

Supplementary European Search Report for Application No. PCT/JP2006309332, European Patent Office, mailed Jul. 13, 2009, 3 pgs.

(Continued)

*Primary Examiner*—Stephen K Cronin
*Assistant Examiner*—Johnny H Hoang
(74) *Attorney, Agent, or Firm*—Sterne, Kessler, Goldstein & Fox P.L.L.C.

(57) ABSTRACT

A fuel injection control method for controlling fuel injection to a plurality of cylinders of an engine is disclosed. The method involves the use of a fuel injection control device that includes a key switch, an engine rotation sensor, and a controller, wherein the key switch initiates an engine stopping operation, engine rotation sensor recognizes fuel injection to a specific cylinder, and then the controller stops fuel injection. A phase difference is provided between fuel injection of the specific engine and that of another engine so as to control fuel injection.

17 Claims, 10 Drawing Sheets

U.S. PATENT DOCUMENTS

| | | | | |
|---|---|---|---|---|
| 6,834,640 | B2 * | 12/2004 | Nishizawa et al. | 123/406.13 |
| 6,935,295 | B2 * | 8/2005 | Marriott | 123/179.5 |
| 7,011,063 | B2 * | 3/2006 | Condemine et al. | 123/179.4 |
| 7,028,656 | B2 * | 4/2006 | Tsuji et al. | 123/179.16 |
| 7,051,693 | B2 * | 5/2006 | Tetsuno et al. | 123/179.5 |
| 7,079,941 | B2 * | 7/2006 | Tetsuno et al. | 701/112 |

FOREIGN PATENT DOCUMENTS

| | | | |
|---|---|---|---|
| JP | 57-93664 | A | 6/1982 |
| JP | 6-93917 | A | 5/1994 |
| JP | 11-107793 | A | 4/1999 |
| JP | 11 107823 | A | 4/1999 |
| JP | 2003-193880 | A | 7/2003 |
| JP | 2004 204747 | A | 7/2004 |
| JP | 2004-360549 | A | 12/2004 |
| WO | WO 2004/067949 | A1 | 8/2004 |

OTHER PUBLICATIONS

International Search Report mailed on Jul. 25, 2006 for International Application No. PCT/JP2006/309332 filed on May 9, 2006, 4 pgs.

* cited by examiner

FUEL INJECTION CONTROL METHOD

TECHNICAL FIELD

The present invention relates to fuel injection control of engines. More specifically, the present invention relates to using fuel injection control to improve startability and reduce vibration of engines.

BACKGROUND ART

Recently, common rail systems (CRS) have been adopted so as to achieve more precise fuel injection control. A CRS controls fuel injection timing and fuel injection volume by controlling an electromagnetic valve of an injector according to engine rotation speed and loading conditions. With regard to the starting control of the engine having a CRS, an injection start cylinder is determined by a specific crank (TDC) signal and a signal indicating an explosion process. Thus, a fuel injection cylinder is not determined based merely on mechanical characteristics, such as a jerk type; the injection start cylinder is determined via the input of the electric signals.

Accordingly, fuel injection can be started at a first cylinder when signals indicating the TDC and explosion process of the first cylinder are received, and the engine is always started by fuel injection at the first cylinder. As another example, a method is also known for shortening discrimination time by analyzing the explosion process signal of each cylinder.

A construction of an electronic control injection device for an internal-combustion engine whose injection order of cylinders is previously determined is also known. This construction comprises an engine rotation sensor, a cylinder discrimination sensor and a cylinder discrimination part (Patent Literature 1). At the rotation of 720° of crank angle of the engine, the engine rotation sensor generates a rotation pulse signal comprising two toothless pulses distant from each other for 360° of crank angle and a plurality of pulses. The cylinder discrimination sensor generates one pulse at the rotation of 720° of crank angle, and this signal is generated simultaneously with one of the two toothless pulses. The cylinder discrimination part determines the engine cylinder to which fuel shall be injected based on the cylinder discrimination pulse signal at the time of generation of the toothless pulses.

Patent Literature 1: the Japanese Patent Laid Open Gazette Hei. 6-93917

BRIEF SUMMARY OF THE INVENTION

With regard to the construction where one cylinder is regarded to as the start cylinder, a sensor is provided to only this cylinder. When fuel injection of engine starting is started, the position of the start cylinder according to the engine stop is different from that of every case according to the key off. Then, when the crank is rotated not more than two revolutions, the start cylinder may not reach the fuel injection start position, thereby reducing the responsiveness at the time of starting compared with that of mechanical type.

With regard to the construction where the discrimination time is shortened by the explosion process signal of each cylinder so as to shorten the time for starting the engine the number of sensors is increased, and expensive sensors such as a hall device are required. Because of this increase of sensors, the possibility of electrical problems is increased.

The art described in the Patent Literature 1 has the similar problem.

Furthermore, when a plurality of engines having CRTs are coupled together and driven, their engine starting times may not be equal. Because of the possible crank phase difference of the engines at the time of starting, the vibrations of each engine may undesirably enhance one another.

By controlling the position of the cylinder at which fuel injection is started at the time of stopping, the cylinder at which fuel injection is started can be specified easily. Then, the action for specifying the cylinder at the time of starting the engine is omitted, and fuel required for the starting is reduced.

Furthermore, in the case where a plurality of engines are driven together, the start timing at the time of starting the engines is controlled so that engine vibration is reduced by the offset among the engines.

According to the present invention, a fuel injection control method for controlling fuel injection to a plurality of cylinders of an engine is characterized in that a fuel injection control device is used comprising an engine stopping operation recognition means, a specific cylinder recognition means and a fuel injection control means, and the engine stopping operation recognition means recognizes engine stopping operation, the specific cylinder recognition means recognizes fuel injection to a specific cylinder, and then the fuel injection control means stops fuel injection.

In addition, the engine stopping operation recognition means may be constructed by a key switch or a sensor. The specific cylinder recognition means may be constructed by a crank sensor, a cam sensor, a cylinder sensor attached to the specific cylinder, or a combination of a memory part in a control unit and a sensor. The fuel injection control means may be constructed by an engine control unit connected to an injector.

According to the present invention, a crankshaft signal is recognized for a fixed period of time after recognizing engine stopping operation by the engine stopping operation recognition means, information specifying a final injection cylinder to which fuel is injected last is stored, a cylinder at least one process after the cylinder specified by the information at the time of engine starting is specified, and fuel injection is started at the cylinder specified second.

According to the present invention, a difference between the final injection cylinder to which fuel is injected last and an engine stop cylinder whose fuel injection timing is later at the time of stopping the engine is recognized, and the final injection cylinder is determined so as to make the engine stop cylinder to be in an explosion process in the case that the engine stop cylinder is not in the explosion process at least one process before the specific cylinder at which fuel is injected at the time of starting the engine.

According to the present invention, in the case that a fixed tendency is not seen between the final injection cylinder to which fuel is injected last and the engine stop cylinder whose fuel injection timing is later or the case that the difference between the final injection cylinder and the engine stop cylinder is not recognized, a predetermined value is adopted as the difference between the final injection cylinder to which fuel is injected last and the engine stop cylinder whose fuel injection timing is later so as to determine the final injection cylinder.

According to the present invention, a plurality of engines each of which has an inherent crankshaft are driven, optional one of the engines is regarded as a reference engine, and a phase difference is provided between start of fuel injection of the reference engine and that of another engine so as to control fuel injection.

In addition, with regard to a plurality of the engines, the phase difference is generated equally so as to reduce the vibration. Then, the phase difference between two of a plurality of the engines reducing the vibration is set. When the number of the engines is odd, the phase difference is generated equally among three engines so as to reduce the vibration.

According to the present invention, a phase difference is provided in start timing of fuel injection so as to reduce compound vibration of a plurality of the engines.

According to the present invention, the phase difference of fuel injection timing between the engines is determined with an engine temperature detection means, setting of time from engine starting, or a vibration detection means.

According to the present invention, crank angle signals of a plurality of the engines are transmitted to one fuel injection control means, and the fuel injection control means recognizes relation among the crank angle signals of a plurality of the engines.

By using the above-mentioned fuel injection control method, the responsiveness at the time of starting the engine is improved with a small numbers of sensors without adding complicated CRS control at the time of starting or expensive mechanism.

Furthermore, with regard to the construction that a plurality of engines are driven, the secondary vibration of the engines is reduced widely.

DETAILED DESCRIPTION OF THE INVENTION

With regard to the present invention, at the time of stopping an engine, a cylinder which finishes an expansion stroke last is recognized so as to specify a cylinder to which fuel is injected at the time of starting the engine, thereby improving startability. Furthermore, the start timing is controlled so as to reduce oscillation in the case of driving a plurality of engines.

Embodiment 1

Next, explanation will be given on the first embodiment according to the drawings.

Figure 1:
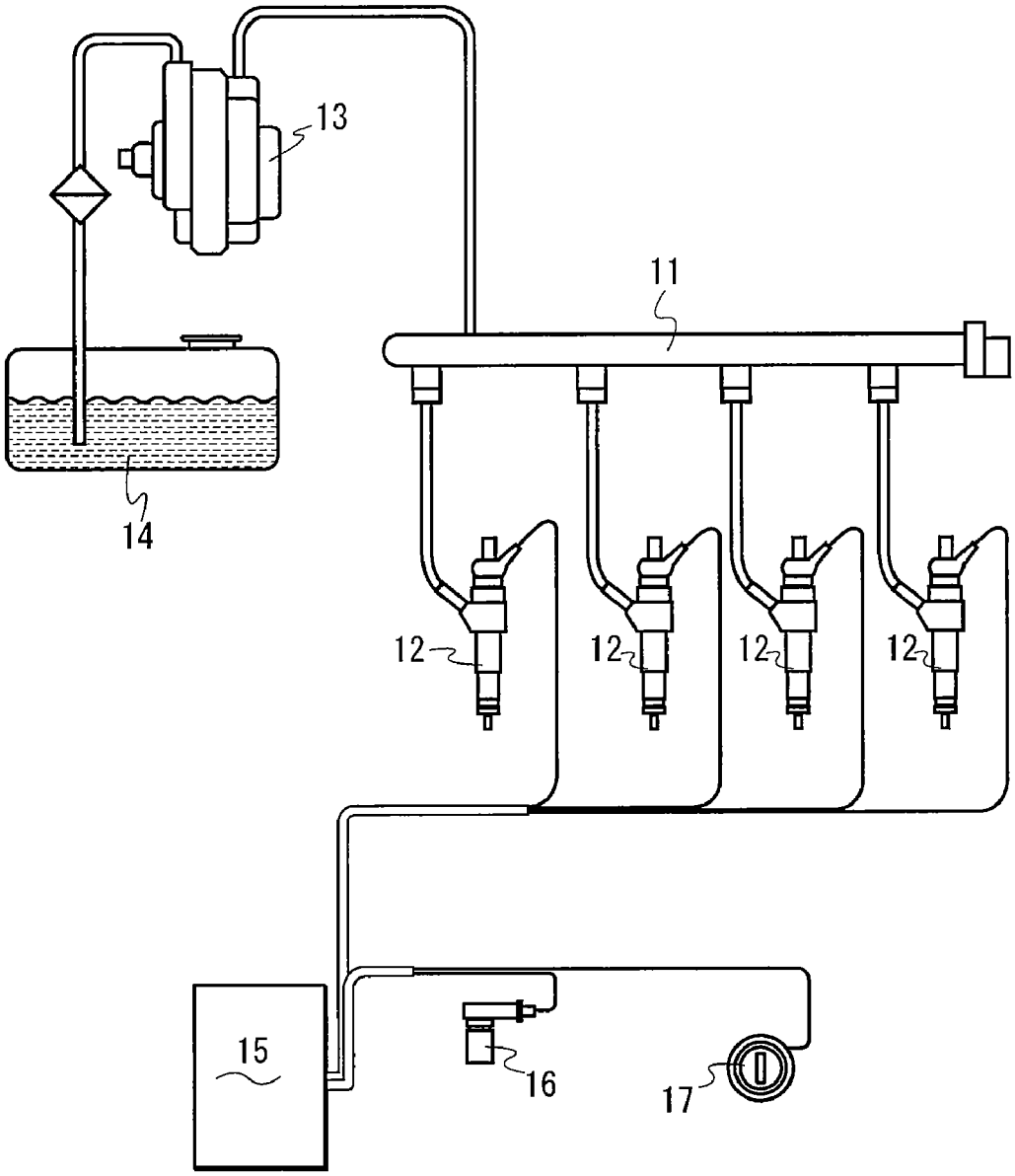
FIG. 1 It is a schematic drawing of a fuel injection control mechanism having a common rail.

FIG. 1 is a schematic drawing of a fuel injection control mechanism having a common rail.

In the first embodiment, the fuel injection control mechanism mainly comprises a fuel pump 13, a common rail 11, injectors 12, a controller 15, an engine rotation sensor 16 and a key switch 17. By the fuel infection control mechanism, fuel is accumulated in the common rail 11 and fuel injection to each of cylinders of the engine is controlled.

The fuel pump 13 pressingly sends fuel from a fuel tank 14 to the common rail 11 through a filter. Fuel is supplied in the common rail 11 at high pressure so as to supply the high pressure fuel to the injectors 12, and a plurality of the injectors 12 are connected to the common rail 11.

Fuel is injected into the cylinders of the engine by the injectors 12. The injectors 12 are controlled electronically by the controller 15 so as to regulate fuel injection timing against the engine rotation.

The engine rotation sensor 16 and the key switch 17 are connected to the controller 15. The controller 15 can recognize the engine rotation state and the state of the top dead point of a piston in the specific cylinder by the engine rotation sensor 16. The engine rotation sensor 16 may comprise a pickup sensor disposed in the vicinity of a gear rotated synchronously with a crankshaft of the engine. A part of the gear corresponding to the top dead point of the specific cylinder is notched so as to recognize the engine rotation state and the top dead point state of the piston of the specific cylinder by the engine rotation sensor 16.

The controller 15 recognizes the ON/OFF state of the key switch 17. By recognizing the operation of the key switch 17 from ON to OFF, the engine stopping operation is recognized.

Next, explanation will be given on the control at the time of stopping the engine. At the time of stopping the engine, the engine is controlled to be stopped at the specific cylinder so as to make the discrimination of the starting cylinder to which fuel is injected easy, thereby making the engine starting easy.

Figure 2:
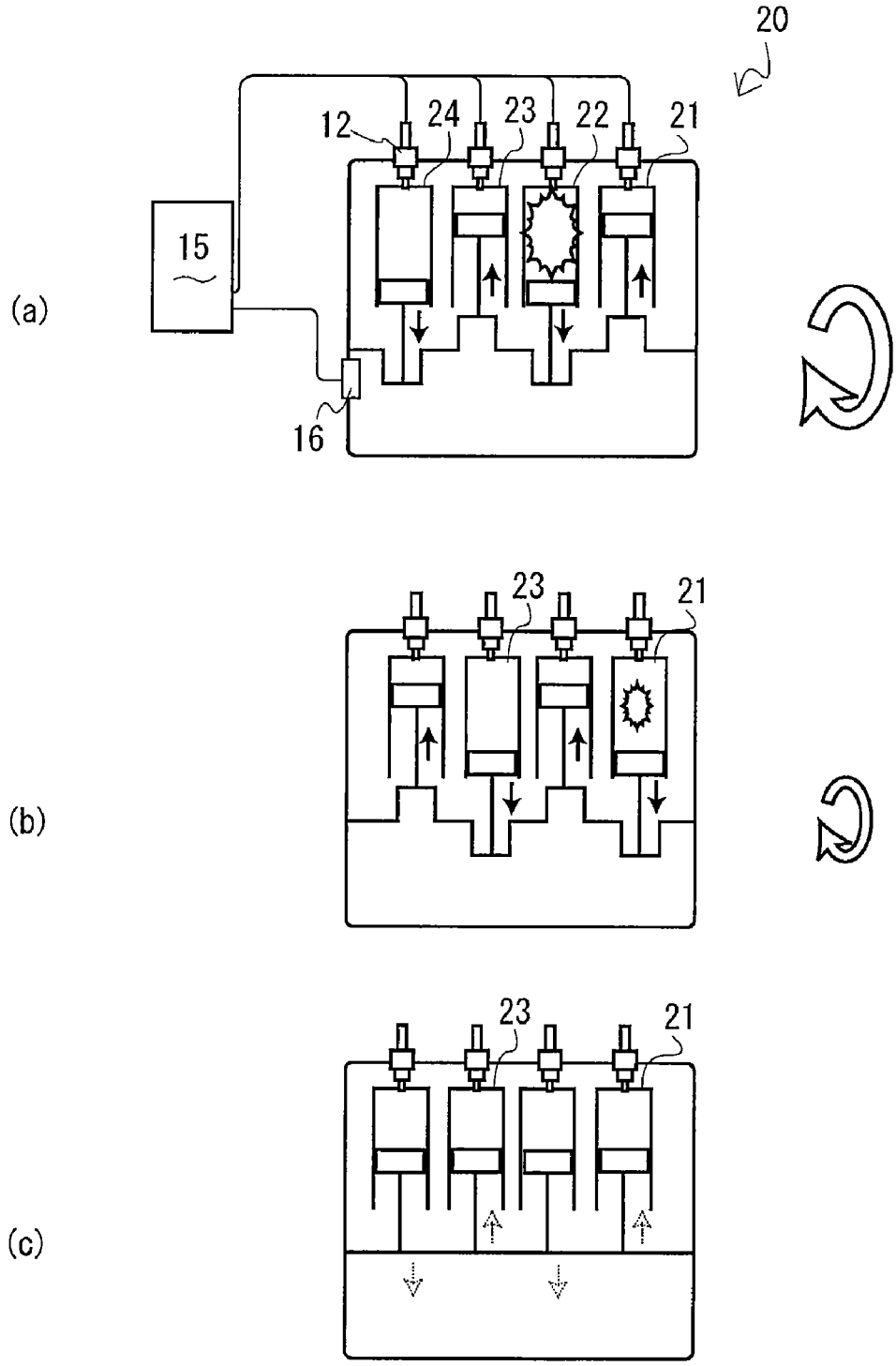
FIG. 2 It is a schematic drawing of control construction at the time of stopping an engine.

FIG. 2 is a schematic drawing of control construction at the time of stopping the engine. With regard to the construction shown in FIG. 2, four cylinders 21, 22, 23 and 24 are disposed in the engine 20. In each of the cylinders, a piston is disposed and the injector 12 is mounted. Each of the four cylinders repeats processes of intake, compression, explosion and exhaust, and fuel is injected in the compression process. In addition, in FIG. 2, the variation with time of the engine 20 is shown by FIG. 2(*a*), FIG. 2(*b*) and FIG. 2(*c*).

In this embodiment, the engine is started by fuel injection in the specific cylinder, and engine is stopped at the cylinder to which fuel is injected before the specific cylinder. In FIG. 2, the specific cylinder to which fuel is started to be injected at the time of starting the engine is referred to as the cylinder 23.

The injectors 12, the engine rotation sensor 16 and the key switch 17 (not shown) are connected to the controller 15. A memory part storing information is provided in to the controller 15, and the cylinder 23 is remained in the memory part as the specific cylinder. The controller 15 recognizes the specific cylinder as the injector mounted to the cylinder 23, and fuel injection to the injector 12 mounted to the cylinder 23 is controlled corresponding to the input value (or input waveform) of the engine rotation sensor 16.

When the key switch 17 has been turned on, the drive of the engine is maintained, and when the key switch 17 is turned off, the engine is controlled to be stopped. With regard to the stopping control of the engine, the engine 20 is driven until the compression process or until fuel injection of the cylinder 23 which is the specific cylinder of the engine 20. Accordingly, at the time of starting the engine, fuel is injected firstly to the cylinder 23. Namely, according to the stopping control of the engine, the cylinder 23 is set to be a starting injection cylinder.

In FIG. 2, when the key switch 17 is operated from ON to OFF between FIG. 2(*a*) and FIG. 2(*b*), the controller 15 controls fuel injection so as to set the cylinder 21 to be an explosion cylinder one process before the cylinder 23 at the time of stopping the engine.

With regard to the engine 20 shown in FIG. 2, the explosion cylinder is shifted in the order of 23, 24, 22, 21, 23 and so on. By setting the cylinder 21 to be the explosion cylinder at the time of stopping the engine (the last explosion cylinder), the cylinder 23 shifted to the explosion process next to the cylinder 21 is set to be the starting injection cylinder.

As shown in FIG. 2(*b*), the controller 15 controls the engine so that fuel has been injected to the cylinder 21 after the key switch 17 is turned off, whereby the cylinder 23 is set to be the starting injection cylinder. In addition, the amount of fuel injection is adjusted by the controller 15 so as to shift the cylinder 23 to the state at least one process before the explosion process (the compression process or the intake process). The engine rotation speed and the like are judged, and when fuel injection in the cylinder 21 is not necessary because of the inertia of the engine or the like, fuel is not injected.

Namely, the controller 15 controls the engine after the key switch 17 is turned off and the cylinder 23 is set to be the starting injection cylinder so as to provide against the starting of the engine.

Accordingly, the cylinder in which fuel injection is started has been known previously and the time required for starting the engine is shortened.

Figure 3:
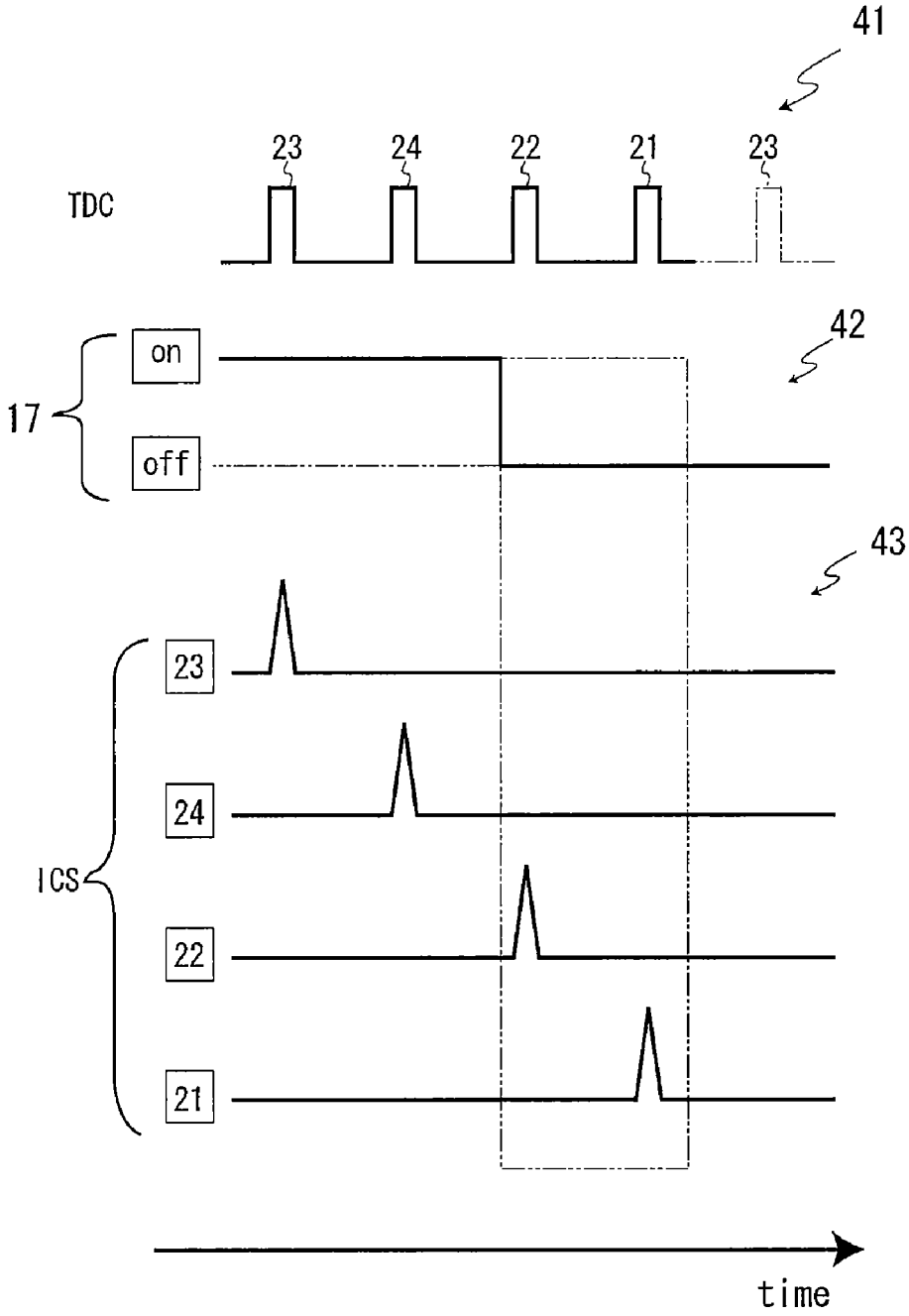
FIG. 3 It is a schematic diagram of state of signals recognized by a controller.

FIG. 3 is a schematic diagram of state of signals recognized by the controller.

A signal 41 indicating the position of dead point of each cylinder and a signal 42 indicating the ON/OFF state of the key switch 17 are inputted into the controller 15, and a signal 43 controlling each injection is outputted. In FIG. 3, after fuel is injected to the cylinder 24, the key switch 17 is operated from ON to OFF. In this situation, the controller 15 recognizes the cylinder 23 as the specific cylinder (starting injection cylinder), and fuel is injected to the cylinders 22 and 23 so as to stop the engine before the explosion process of the cylinder 23. Namely, after the key switch 17 is turned off, the specific cylinder is set to be the starting injection cylinder by fuel injection.

Accordingly, at the time of starting the engine, the cylinder 23 is shifted to the state one process before the explosion process so as to improve responsiveness at the time of starting the engine.

Figure 4:
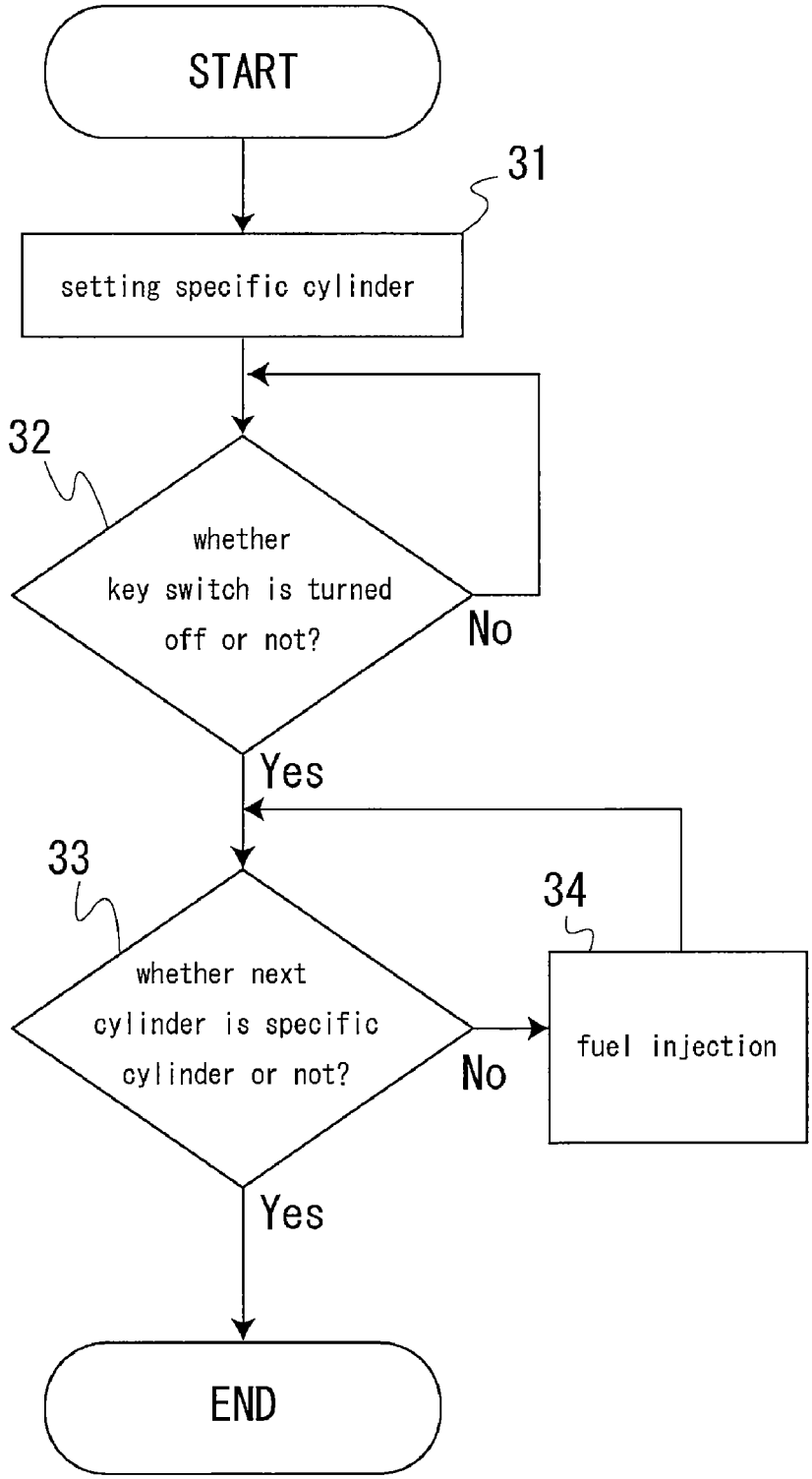
FIG. 4 It is a flow chart of fuel injection control at the time of stopping the engine.

FIG. 4 is a flow chart of fuel injection control at the time of stopping the engine.

Explanation will be given on the fuel injection control by the controller 15 according to the flow chart of FIG. 4.

Firstly, the specific cylinder is set at management 31. In the embodiment shown in FIG. 3, the cylinder 23 is set as the specific cylinder. Then, the ON/OFF state of the key switch 17 is recognized at discrimination 32. When the key switch 17 has been turned on, the discrimination 32 is repeated, and when the key switch 17 is turned off, the cylinder to be shifted to the fuel injection process next to the cylinder at the fuel injection process presently is considered at discrimination 33. When the next cylinder is not the specific cylinder, fuel is injected to the cylinder at the fuel injection position at management 34. When the next cylinder is the specific cylinder, fuel is not injected and the control is finished.

Accordingly, the engine is stopped while the specific cylinder will be shifted to the explosion process next, whereby the time required for starting the engine is shortened.

Embodiment 2

Next, explanation will be given on the second embodiment of the fuel injection control.

Figure 5:
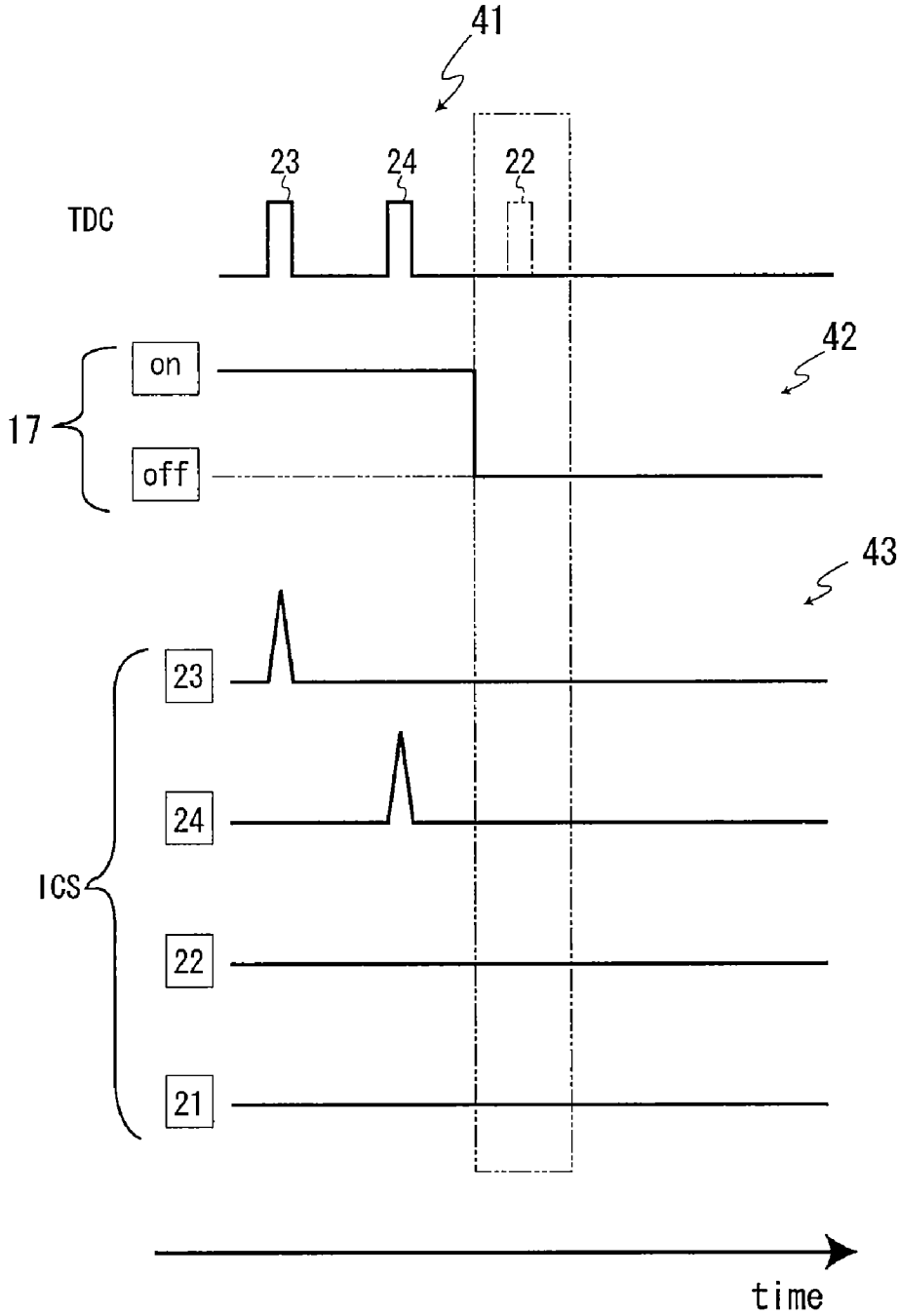
FIG. 5 It is a schematic diagram of a control mechanism of the controller in the second embodiment.

FIG. 5 is a schematic diagram of a control mechanism of the controller in the second embodiment.

With regard to the second embodiment, the cylinder which becomes the engine stop cylinder after the key switch 17 is turned off is recognized, and the cylinder which will be shifted to the explosion process next to the engine stop cylinder is set to be the starting injection cylinder. At the time of starting the engine fuel injection is started at the starting injection cylinder.

The explosion cylinder is shifted in the order of 23, 24.22 and 21. As shown in FIG. 5, the key switch 17 is turned off after fuel injection to the cylinder 24. When the engine is stopped, the controller 15 recognizes the cylinder 22, which will be shifted to the explosion process next to the cylinder 24, as the starting injection cylinder and maintains this information. The controller 15 recognizes the cylinder to which fuel is injected and maintains the information of the cylinder to which fuel is injected for each fuel injection. When the signal which has not been detected by the movement of the cylinder to the top dead point (TDC) for a fixed period of time after fuel injection, the controller 15 recognizes the stop of the engine, and the cylinder 24 to which fuel will be injected next to the cylinder whose information is maintained last is recognized as the starting injection cylinder, and fuel injection is started at the cylinder 24 at the time of starting the engine. Accordingly, the time required for starting is shortened.

With regard to the embodiment 2, the cylinder that the TDC signal corresponding to it is received last is recognized as a last cylinder, and fuel injection is started at the cylinder to which fuel will be injected next to the last cylinder at the time of starting the engine. The controller 15 stores and maintains the cylinder next to the cylinder that the TDC signal corresponding to it is recognized last as the starting injection cylinder, whereby the engine is started smoothly. The starting injection cylinder may be the cylinder at the state at least one process before the cylinder that the TDC signal corresponding to it is recognized last (the cylinder at the compression process or the intake process).

Namely, the last cylinder is recognized in the operation period of the controller 15 optionally set after turning off the key switch 17, and the starting injection cylinder is calculated from the last cylinder. Accordingly, the time required for starting the engine is shortened.

Alternatively, it may be considered that the engine is advanced for several processes by the inertia or the like after turning off the key switch 17. The controller 15 recognizes the cylinder recognized just before turning off the key switch 17 and the last cylinder at which the explosion process is finished at the complete stop state of the engine, and then the phase difference against the calculated starting injection cylinder is stored and maintained as a difference of fuel injection order statistically by the controller 15.

For example, when the key switch 17 is turned off after the explosion process is finished at the cylinder 23, supposing that the probability shifting to the starting injection cylinder of the cylinder 24 is 5%, that of the cylinder 22 is 85%, and that of the cylinder 21 is 10%, the time for starting the engine can be shortened mostly by setting the cylinder 22 two processes before the cylinder 23 recognized just before turning off the key switch.

Accordingly, frequent difference is set as the difference between the cylinder just before turning off and the starting injection cylinder and the cylinder just before turning off the key switch 17 is recognized from the difference so as to calculate the starting injection cylinder.

The controller 15 learns the relation between the cylinder just before turning off the key switch 17 and the starting injection cylinder so as to shorten or erase the actuation time of the controller 15 after turning off the key switch after finishing an initial learning process of the controller 15.

Namely, the controller 15 recognizes the cylinder just before turning off the key switch 17 so as to calculate the last cylinder. The starting injection cylinder is calculated from the last cylinder, whereby the actuation time of the controller 15 after turning off the key switch 17 is shortened.

The controller 15 previously stores the difference between the cylinder just before turning off the key switch and the starting injection cylinder as a set value. According to the set value, the starting injection cylinder is calculated from the cylinder just before turning off the key switch.

The controller 15 previously stores the difference between each cylinder which is just before turning off the key switch and the starting injection cylinder. The controller 15 recognizes the cylinder to which fuel is injected. When the key switch 17 is operated from ON to OFF, the controller 15 calculates the starting injection cylinder from the value of "difference" corresponding to the cylinder to which fuel is injected just before. Accordingly, the engine control is simple and easy.

Embodiment 3

Next, explanation will be given on the third embodiment.

With regard to the third embodiment, two control methods are used. One of the two methods is a fuel injection control method where the specific cylinder of the engine which is the starting injection cylinder is determined previously and the control is performed after turning off the key switch 17 so as to make the specific cylinder to be the starting injection cylinder. The other method is a fuel injection control method where the starting injection cylinder is calculated from the cylinder just before turning off the key switch according to a learned value or a predetermined "difference". The particular fuel injection control methods used in the third embodiment are selected among these above described methods in consideration of the conditions.

When one of the fuel injection control methods is not effective to start the engine, the other fuel injection control method is selected.

The ease of engine starting is judged by recognizing the time from starting rotation of a starter to starting drive by the combustion of the engine (i.e., an increase of rotary speed). The controller 15 stores a reference time previously and the time for starting the engine is measured, and then the measured time is compared with the reference time so that the controller 15 judges the ease of engine starting.

Since the key switch 17 which is a starting switch of the starter and the engine rotation sensor are connected to the controller 15, the judgement can be performed by the controller 15.

In the case that the measured values of the cylinder just before turning off the key switch deviate and the learned value cannot be determined, or the case that the determination of the starting cylinder from the learned value is not effective for the engine starting, the fuel injection control method is selected which is performed after turning off the key switch 17 so as to make the specific cylinder to be the starting injection cylinder. When the fuel injection control method which is performed after turning off the key switch 17 so as to make the specific cylinder to be the starting injection cylinder is not efficient for the engine starting, the other fuel injection control method is used.

Accordingly, since the control methods can be selected in consideration of the conditions of the engine starting, the fuel injection control method can be provided which can deal with various engines widely.

Embodiment 4

The fuel injection control method shown in the above-mentioned embodiment controls the engine starting and can be adopted to the starting of a plurality of engines so as to improve silence of the engine drive. In the case of driving a plurality of engines, the timing of engine starting is controlled so as to reduce compound vibration of a plurality of the engines.

With regard to the fourth embodiment, in the case of driving a plurality of engines, the engine vibration is reduced by the fuel injection control. Explanation will be given on a construction of two machines and two axles driving two engines 20*a* and 20*b* as an example of construction of a plurality of engines.

Figure 6:
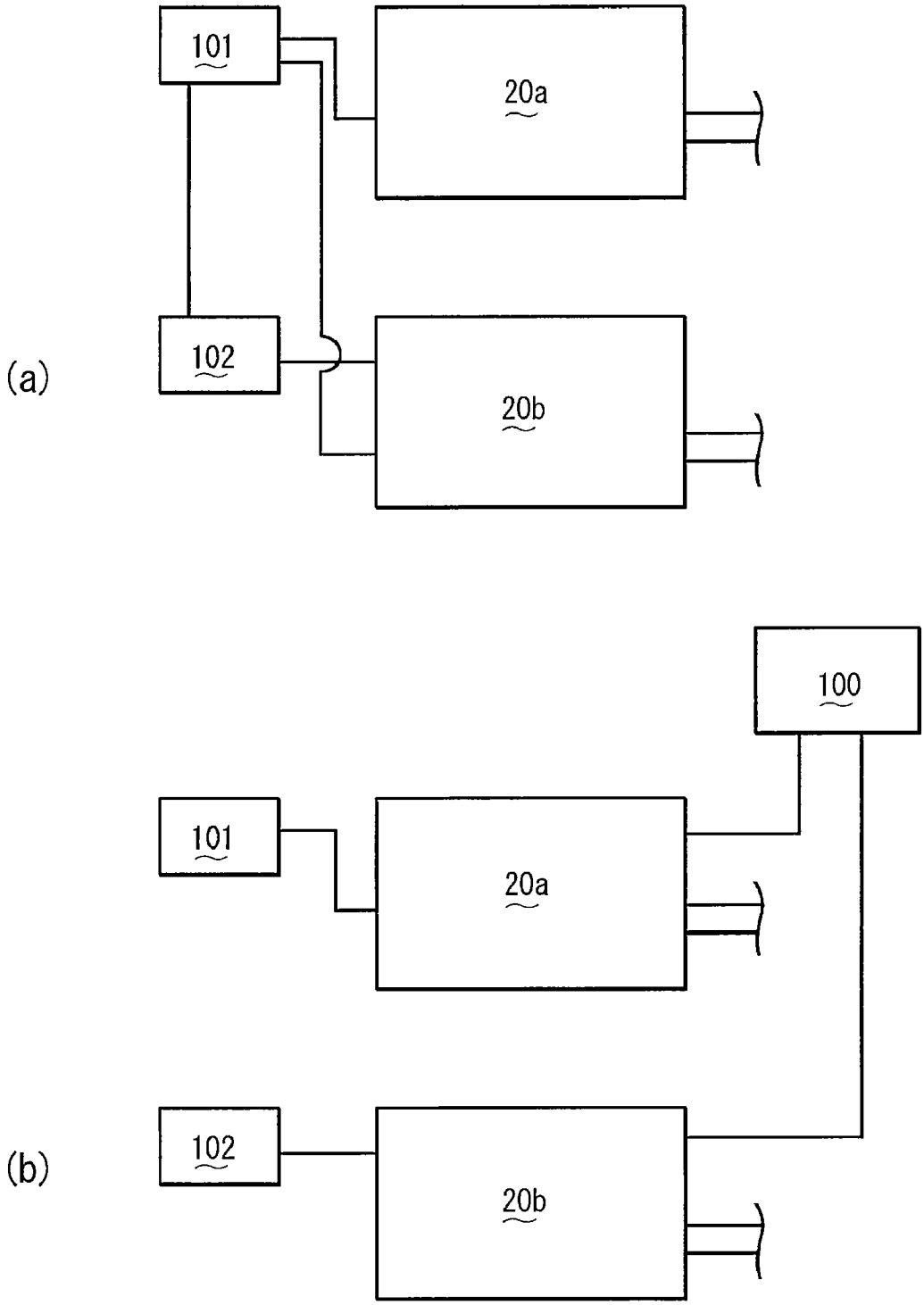
FIG. 6 It is a schematic drawing of connection construction of the engine and the controller.
Figure 7:
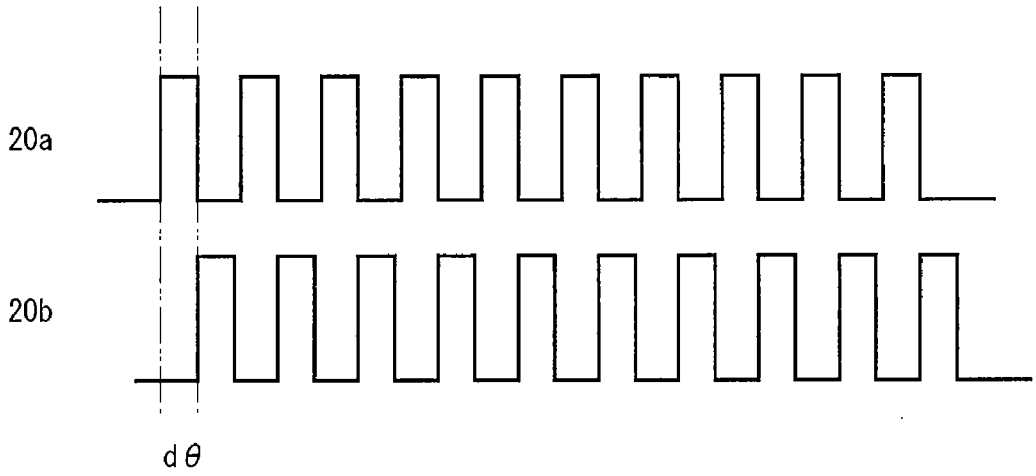
FIG. 7 It is a schematic diagram of construction of phase difference control by a crankshaft signal.

FIG. 6 is a schematic drawing of connection construction of the engine and the controller. FIG. 6(*a*) is a drawing of construction that two controllers are connected. FIG. 6(*b*) is a drawing of construction that two engines are controlled by one controller. FIG. 7 is a schematic diagram of construction of phase difference control by a crankshaft signal.

Firstly, explanation will be given on the construction that two controllers are connected according to FIG. 6(*a*). Controllers 101 and 102 are respectively connected to the engines 20*a* and 20*b* so as to control fuel injection thereof. Furthermore, the controller 101 is also connected to the controller 102 so that the controller 101 can control the controller 102.

In the case of fuel injection control at the time of engine starting, fuel injection timing of one of the engines 20*a* and 20*b* is controlled corresponding to that of the other thereof so as to cancel the secondary vibration of the engines, whereby the total vibration of the two engines is reduced.

Crank signals of the engines 20*a* and 20*b* are inputted to the controller 101 so that the controller 101 recognizes the phase difference between the engines 20*a* and 20*b*.

The controller 101 starts fuel injection of the engine 20*a*, and the controller 102 recognizes fuel injection timing of the engine 20*a* and starts fuel injection of the engine 20*b* at the timing delayed for half-wave length from the secondary vibration transmitted from the controller 101. Accordingly, the secondary vibration is canceled between the two engines. The regular interval explosion phase difference of the number of cylinders is given by the two engines so as to reduce the engine vibration.

The information about the number of cylinders and the shape of the engines 20*a* and 20*b* is inputted to the controllers 101 and 102 and is stored. The phase difference between the engines is calculated from the information, and the engines 20*a* and 20*b* are controlled so as to reduce the engine vibration.

Namely, as shown in FIG. 7, a phase difference $d\theta$ optimum to reduce the vibration between the engines is calculated between the two engines and the engine vibration is reduced by applying the phase difference $d\theta$. For example, with regard to in-line four engines, a phase difference of 180° is applied so as to cancel vibration of the engines.

The controller 101 may control the engines 20*a* and 20*b*. The controller 101 adjusts the start timing of the engines 20*a* and 20*b* so that two engines are controlled by one controller. Then, the controller 102 is regarded as a spare, whereby the reliability of the engine control is improved.

In addition, instead of inputting the crank signals of the engines 20*a* and 20*b* to the controller 101, the controller 101 may be able to recognize the phase difference between the engines 20*a* and 20*b*. The phase difference of the engines can be controlled by an optional means recognizing the phase difference of the engines.

With regard to the construction of FIG. 6(*b*), the controller 100 controls the engines 20*a* and 20*b*. The crank signals of the engines 20*a* and 20*b* are inputted to the controller 100, and the phase difference of engine rotation between the two engines is controlled with the fuel injection timing.

Accordingly, by inputting the crank signals of a plurality of the engines to one controller 100, the vibration of a plurality of the engines is reduced wholly. In addition, the controllers 101 and 102 are respectively connected to the engines 20*a* and 20*b*, and the controller connected to each engine can be used when the controller 100 is broken or when one of the engines is driven individually.

Next, explanation will be given on control construction of idling rotation speed.

Figure 8:
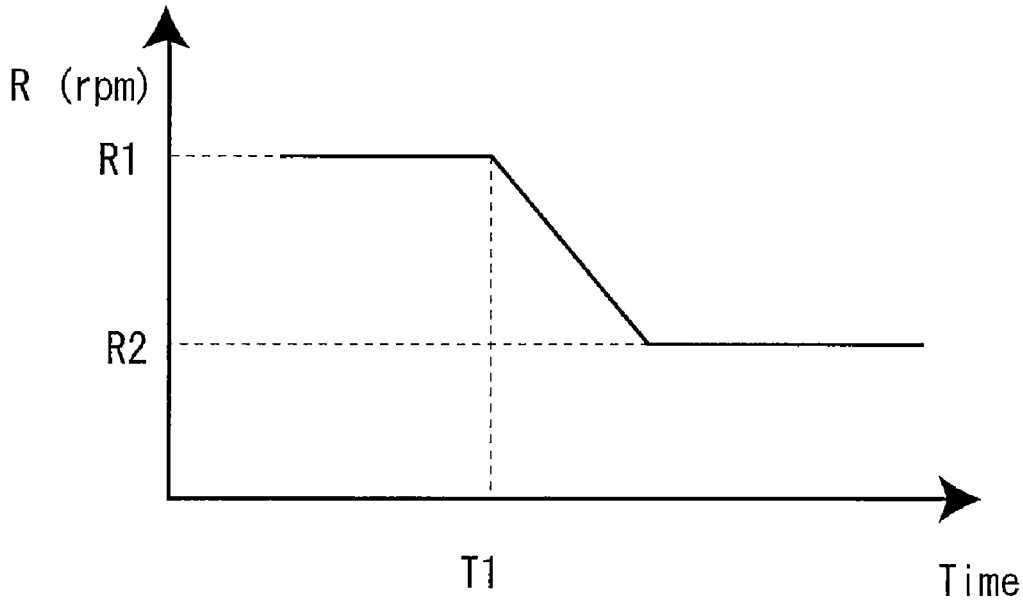
FIG. 8 It is a diagram of control construction of idling rotation speed.

FIG. 8 is a diagram of control construction of idling rotation speed. The axis of ordinates indicates the engine rotation speed, and the axis of abscissas indicates the time.

The controller 100 or 101 sets the phase difference between a plurality of engines so as to reduce the vibration of the engines, and then performs control so as to reduce idling rotation speed of the engines. Firstly, the phase difference is determined so as to reduce the vibration at prescribed engine rotation speed, and then engine control is performed so as to reduce the idling rotation speed. In FIG. 8, the phase difference is determined at engine rotation speed R1 and time T1 and then the idling rotation speed is reduced gradually to engine rotation speed R2.

For example, with regard to the construction controlling two engines, when engine explosion degree is set to be an optional phase difference so as to reduce engine vibration, the idling rotation speed is controlled to be reduced. Concretely, with regard to the engine construction mounted on a ship with two machines and two axles, a phase difference is set so as to reduce vibration of two engines at engine rotation speed of 900 rpm at the time of starting, and then the engine rotation speed is set to be 500 rpm.

Accordingly, the setting for reducing engine vibration can be calculated easily, and the idling rotation speed is reduced so that silence at the time of idling is improved, whereby fuel consumption is reduced.

Next, explanation will be given on construction that a phase difference between engines is determined with a parameter different from engine rotation speed so as to control fuel injection timing of the engines.

Firstly, explanation will be given on construction that the phase difference is adjusted by a means recognizing temperature of the engines. The characteristics of the engine are changed depending on the temperature thereof. Especially, there is well known that viscosity of engine oil is changed depending on the temperature. Then, the phase difference between the engines is controlled corresponding to the temperature of the engines so as to reduce the engine vibration corresponding to the actual characteristics of the engines more accurately. A temperature sensor attached to each engine or a noncontact temperature sensor may be used as the detection means of engine temperature.

Figure 9:
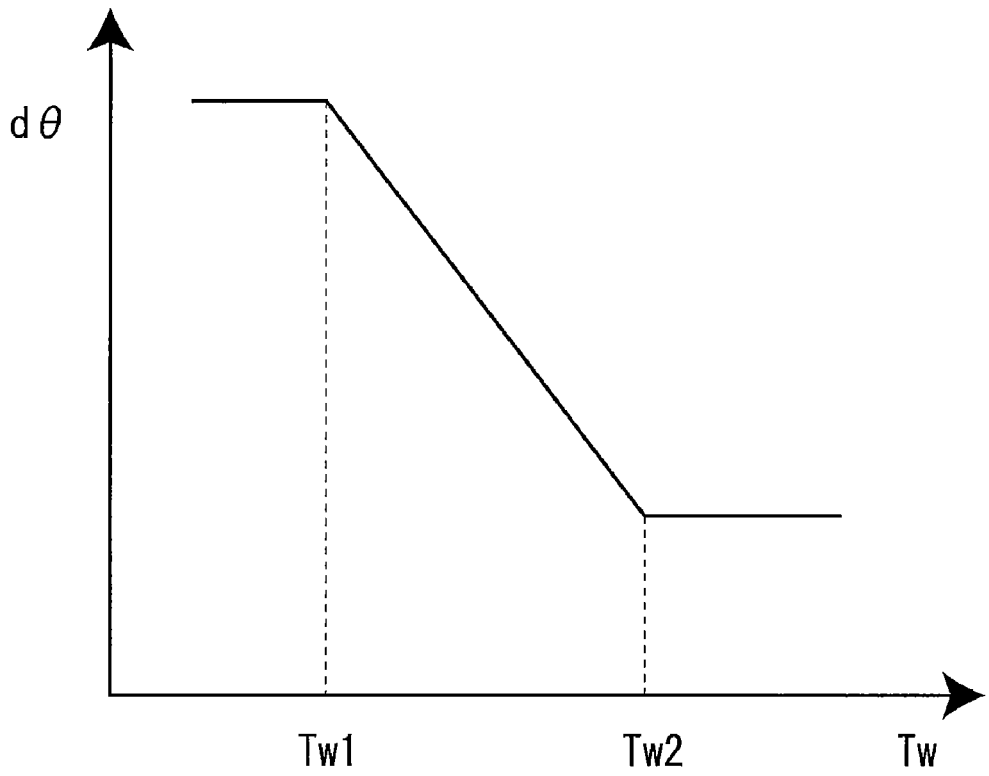
FIG. 9 It is a diagram of construction of phase difference control by engine temperature.

FIG. 9 is a diagram of construction of phase difference control by engine temperature. The axis of ordinates indicates the absolute value of the phase difference, and the axis of abscissas indicates the engine temperature.

Explanation will be given on an example of control construction of phase difference with engine temperature according to FIG. 9. The phase difference between the engines is fixed until temperature Tw1, reduced following the temperature from the temperature Tw1 to temperature Tw2, and is fixed from Tw2. Accordingly, the phase difference between the engines is controlled corresponding to the temperature so as to reduce the engine vibration at the state close to the actual engine characteristics.

Explanation will be given on construction that a phase difference between engines is determined with the engine rotation speed sensor and a vibration detection means so as to control fuel injection timing of the engines.

Figure 10:
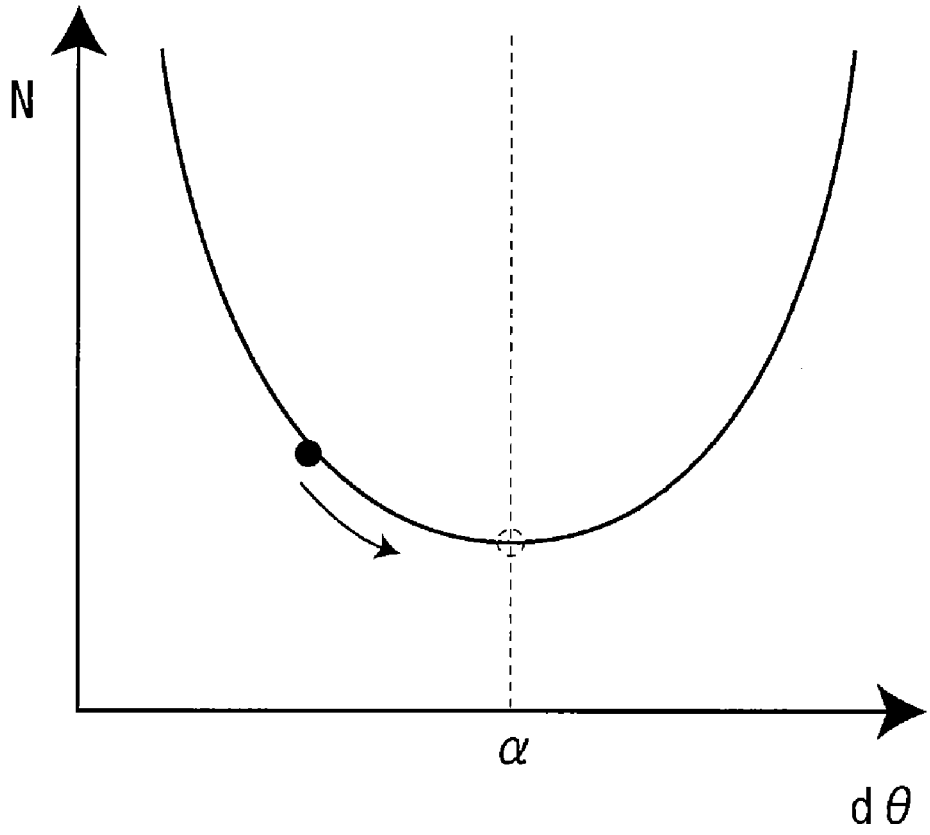
FIG. 10 It is a diagram of relation between oscillation and phase difference.

FIG. 10 is a diagram of relation between oscillation and phase difference. In FIG. 10, the axis of ordinates indicates the amount of vibration, and the axis of abscissas indicates the absolute value of the phase difference. With regard to the engine vibration reduction construction with the vibration detection means, vibration amount is recognized by a vibration sensor or the like so as to adjust the phase difference between the engines, whereby the engine vibration is reduced.

The controller 101 or 100 controlling the engine calculates initial value of phase difference reducing the engine vibration from the numeric information of engine characteristics. Then, the engines are started with the initial set phase difference. After starting the engine, while the actual engine vibration is recognized by the vibration sensor, the phase difference is adjusted to phase difference $\alpha$ at which the vibration is at a minimum.

With regard to the adjustment to the phase difference $\alpha$, the phase difference is increased or decreased from the initial set phase difference so as to be adjusted for reducing the measured engine vibration frequency. For example, in the case that phase difference al is set initially, the phase difference is increased and then the vibration before changing the phase difference is compared with that after changing the phase difference. When the vibration after changing the phase difference is larger than that before changing the phase difference, the phase difference before changing is stored as the phase difference $\alpha$. Then, the engines are controlled while the phase difference between the engines is regarded as the phase difference $\alpha$.

The present invention can be used as an art for fuel injection control of an engine, and can be used for improving startability and reducing vibration by the fuel injection control of the engine.

The invention claimed is:

1. A fuel injection control method for controlling fuel injection to a plurality of cylinders of an engine, the fuel injection control method comprising the steps of:

executing a first fuel injection control method, the first fuel injection control method comprising the steps of:

predetermining a starting injection cylinder to which fuel is to be injected first when starting the engine;

predetermining a final injection cylinder, based on the step of predetermining a starting injection cylinder, to which fuel is to be injected last when stopping the engine;

injecting fuel to the plurality of cylinders one after the other according to an injection order, wherein the injection occurs in response to the engine being started;

recognizing an engine stopping operation during the step of injecting fuel;

recognizing fuel injection of the final injection cylinder in response to the step of recognizing the engine stopping operation; and stopping fuel injection in response to the step of recognizing fuel injection of the final injection cylinder, so that fuel is capable of being injected to the starting injection cylinder first when restarting the engine.

2. The fuel injection control method as set forth in claim 1, further comprising the steps of:

selectively executing the first fuel injection control method or a second fuel injection control method, wherein the second fuel injection control method comprises the steps of:

injecting fuel to the plurality of cylinders one after the other according to the injection order, wherein the injection occurs in response to the engine being started:

recognizing an engine stopping operation during the step of injecting fuel;

recognizing a crankshaft signal in response to the step of recognizing the engine stopping operation;

identifying the final injection cylinder based on the step of recognizing the crankshaft signal, wherein the final injection cylinder is a cylinder that reaches a top dead point last after the step of recognizing the engine stopping operation occurs; and identifying the starting injection cylinder based on the step of identifying the final injection cylinder, so that fuel is capable of being first injected to the starting injection cylinder when restarting the engine.

3. The fuel injection control method as set forth in claim 2, wherein the second fuel injection control method further comprises the steps of:

recognizing a timing of an event in a cylinder just before the engine stopping operation in response to the step of recognizing the engine stopping operation;

recognizing a timing of an event in the final injection cylinder in response to recognizing the timing of the event in the cylinder just before the engine stopping operation;

determining a phase difference between the timing of the event in the cylinder just before the engine stopping operation and the timing of the event in the final injection cylinder;

determining a set phase difference between the timing of the event in the cylinder just before the engine stopping operation and the timing of the event in the starting injection cylinder based on the phase difference determined in the step of determining the phase difference; and determining which cylinder is the starting injection cylinder based on the timing of the event in the cylinder just before the engine stopping operation and the set phase difference.

4. The fuel injection control method as set forth in claim 3, wherein in the second fuel injection control method, the set phase difference is replaced with a predetermined value to serve as the set phase difference.

5. The fuel injection control method as set forth in claim 1, wherein a plurality of engines each having a crankshaft are driven, wherein one of the engines is regarded as a reference engine, and wherein a phase difference is provided between a start of fuel injection of the reference engine and that of another engine so as to control fuel injection.

6. The fuel injection control method as set forth in claim 5, wherein the phase difference is provided to reduce compound vibration of a plurality of the engines.

7. The fuel injection control method as set forth in claim 5, wherein the phase difference is determined with an engine temperature detector, setting of time from engine starting, or a vibration detector.

8. The fuel injection control method as set forth in claim 5, wherein crank angle signals of the plurality of engines are transmitted to one fuel injection controller, and the fuel injection controller recognizes relationships among the crank angle signals of the plurality of engines.

9. The fuel injection control method as set forth in claim 2, wherein a plurality of engines each having a crankshaft are driven, wherein one of the engines is regarded as a reference engine, and wherein a phase difference is provided between a start of fuel injection of the reference engine and that of another engine so as to control fuel injection.

10. The fuel injection control method as set forth in claim 3, wherein a plurality of engines each having a crankshaft are driven, wherein one of the engines is regarded as a reference engine, and wherein a phase difference is provided between a start of fuel injection of the reference engine and that of another engine so as to control fuel injection.

11. The fuel injection control method as set forth in claim 4, wherein a plurality of engines having a crankshaft are driven, wherein one of the engines is regarded as a reference engine, and wherein a phase difference is provided between a start of fuel injection of the reference engine and that of another engine so as to control fuel injection.

12. The fuel injection control method as set forth in claim 9, wherein the phase difference is provided to reduce compound vibration of a plurality of the engines.

13. The fuel injection control method as set forth in claim 10, wherein the phase difference is provided to reduce compound vibration of a plurality of the engines.

14. The fuel injection control method as set forth in claim 11, wherein the phase difference is provided to reduce compound vibration of a plurality of the engines.

15. The fuel injection control method as set forth in claim 9, wherein the phase difference is determined with an engine temperature detector, setting of time from engine starting, or a vibration detector.

16. The fuel injection control method as set forth in claim 10, wherein the phase difference is determined with an engine temperature detector, setting of time from engine starting, or a vibration detector.

17. The fuel injection control method as set forth in claim 11, wherein the phase difference is determined with an engine temperature detector, setting of time from engine starting, or a vibration detector.

* * * * *